United States Patent [19]

Osako

[11] 4,253,048

[45] Feb. 24, 1981

[54] FILAMENT HEATING APPARATUS

[75] Inventor: Teruaki Osako, Yokohama, Japan

[73] Assignee: Tokyo Shibaura Denki Kabushiki Kaisha, Kawasaki, Japan

[21] Appl. No.: 924,566

[22] Filed: Jul. 14, 1978

[30] Foreign Application Priority Data

Jul. 15, 1977 [JP] Japan ..... 52/84144
Mar. 17, 1978 [JP] Japan ..... 53/29799

[51] Int. Cl.[2] ..... H05G 1/34
[52] U.S. Cl. ..... 315/307; 250/409; 315/106; 315/107; 315/279; 315/293
[58] Field of Search ..... 315/106, 107, 224, 279, 315/291-293, 307; 328/270; 250/401-403, 409

[56] References Cited

U.S. PATENT DOCUMENTS 3,783,287 1/1974 Fulton et al. ..... 250/409 X
3,916,251 10/1975 Hernandez et al. ..... 315/106
4,072,865 2/1978 Craig et al. ..... 315/307 X

FOREIGN PATENT DOCUMENTS 2102686 5/1978 Fed. Rep. of Germany ..... 250/409

*Primary Examiner*—Eugene R. LaRoche
*Attorney, Agent, or Firm*—Cushman, Darby & Cushman

[57] ABSTRACT

A filament heating apparatus for an X-ray tube having an isolation transformer through which a control signal is digitally transmitted regulates the filament current to be constantly stable. The control signal is comprised of one of a reference signal based upon the characteristics of the X-ray tube and a component of the filament current.

10 Claims, 7 Drawing Figures

FILAMENT HEATING APPARATUS

The present invention relates to a filament heating apparatus for an X-ray tube to stably heat the filament of an X-ray tube.

In an X-ray apparatus, it is desirable that radiation output radiated from an X-ray tube be constantly stable. The radiation intensity I is proportional to the product of the tube current $I_P$ of the X-ray tube and a voltage $KV_P$ applied between the anode and cathode of the X-ray tube ($I \propto I_P[KV_P]^3$). The tube current $I_P$ is proportional to the filament current $I_F$ flowing through the filament ($I_P \propto I_F^8$). In order to stabilize heating of the filament, therefore, it is necessary to keep the filament current constant. The filament of the X-ray tube is disposed at the high tension generation part side and therefore an AC power source is used as the power source for the X-ray tube. Accordingly, it is a common practice that a power from the power source is fed to the filament through an isolation transformer. In this case, an AC signal stabilizing circuit such as a stabilizer is provided at the primary winding side of the isolation transformer to stabilize the filament current.

Even if the current or voltage at the primary winding side of the isolation transformer is precisely and highly stabilized, however, variation of the filament current due to aging of the isolation transformer is unavoidable. This is a problem in stabilizing the radiation output of the X-ray tube.

Further, a high tension voltage ranging generally from 6 to 15 KV is applied between the anode and cathode of the X-ray tube. For this, if the filament current at the high tension side is fed back to the low tension side through an isolation means in an analogue manner, in order to stabilize the filament current, there is inevitably a limit in improving the stability because of insufficient linearity of the isolation means and drift associated with the tube. Recently, computed tomography apparatus in which various data are processed by a digital computer has been put into practice. In apparatus of this type, it is desirable to digitally control also the heating of the filament.

Accordingly, an object of the invention is to provide a filament heating apparatus for an X-ray tube in which an X-ray output radiated from the X-ray tube is kept stable by stabilizing the filament current.

According to one aspect of the invention, there is provided a highly stabilized filament heating apparatus for an X-ray tube. In the apparatus, a filament current flowing through a filament of an X-ray tube disposed at a high tension side, i.e. a signal at the secondary winding side of an isolation transformer, is detected. The signal is converted at the secondary winding side into a corresponding digital signal, which is fed back to the primary winding side through an isolation transmission path. Then, the digital signal is again converted at the low tension primary side into an analogue signal in order to compare with a reference value. The difference therebetween is used to keep the filament current constant.

The invention also provides another filament heating apparatus for an X-ray tube, wherein, however, the reference value is converted at the low tension primary winding side into a digital signal. Then, the digital signal is transferred to the secondary winding side through an isolation transformer for electrically isolating the low tension primary winding side from the high tension secondary winding side. At the secondary winding side, the digital signal is again converted into an analogue signal which in turn is used as a control signal for providing a proper filament current at the secondary winding side.

Other objects and features of the invention will be apparent from the following description taken in connection with the accompanying drawings, in which.

Figure 1:
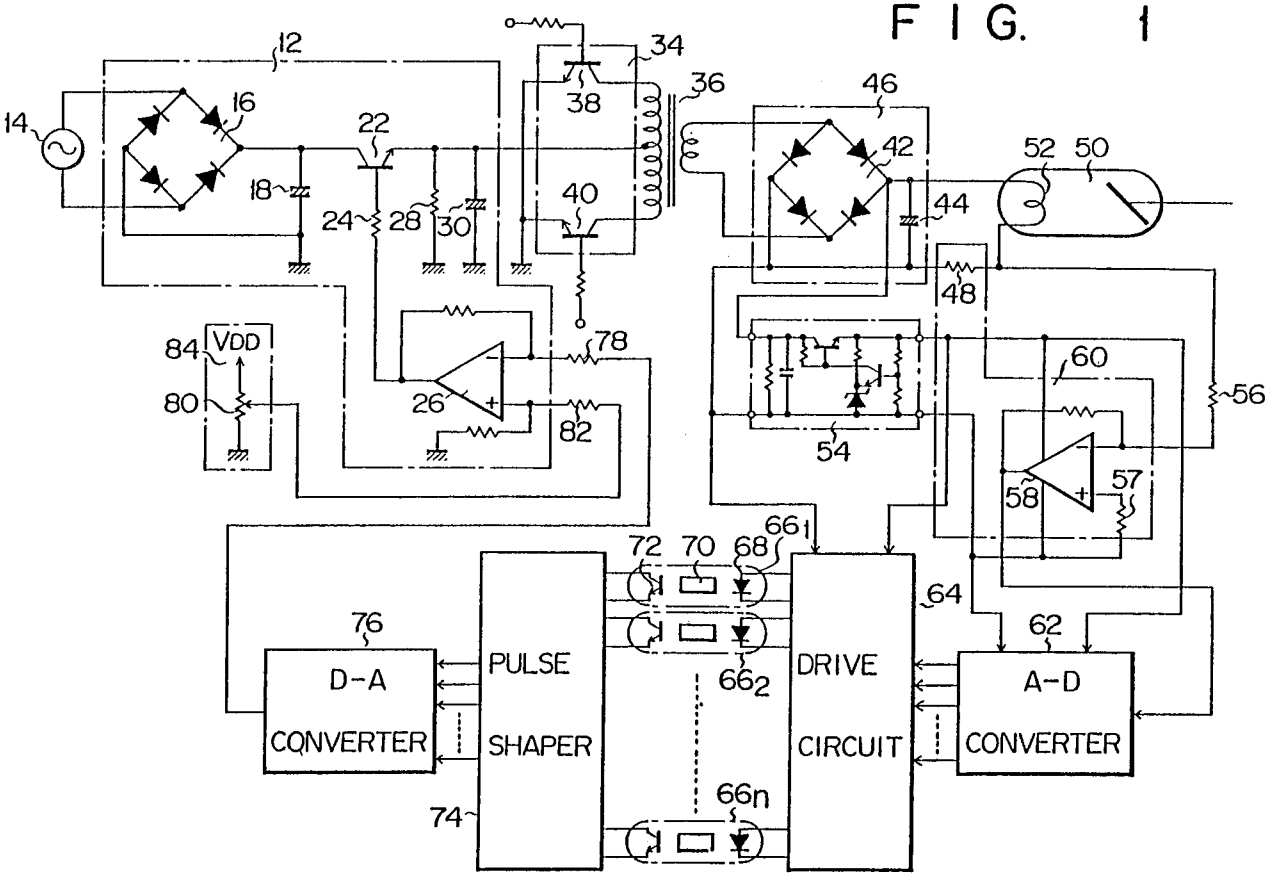
FIG. 1 shows a circuit diagram of a filament heating apparatus according to the invention.

Referring now to FIG. 1, there is shown an embodiment of a filament heating apparatus for an X-ray tube according to the invention. As shown, a stabilized DC power source generally designated by reference numeral 12 is comprised of a full-wave rectifier 16 connected at the input to an AC power source 14 and at the output to a capacitor 18. These components constitute an AC to DC converter. The output of the AC-DC converter 12 is connected to a collector-emitter path of an NPN transistor 22 for current control. The base terminal of the NPN transistor 22 is connected to the output of an error amplifier 26 via a resistor 24. A resistor 28 and a capacitor 30 respectively are connected between the emitter of the transistor 22 and ground (the negative output terminal of the rectifier 16). The resistor 28 and capacitor 30 prevent the circuit 12 from oscillating.

An inverter circuit generally designated by reference numeral 34 includes a pair of transistors 38 and 40. These transistors 38 and 40 are connected to each other at the emitters, and are connected at the collectors to the end terminals of the primary winding of an isolation transformer 36 and at the bases to the output terminals of a gate pulse generator (not shown). The isolation transformer 36 isolates a low tension primary winding side from a high tension secondary winding side. The center tap of the primary winding of the isolation transformer 36 is connected to the emitter of the current control transistor 22.

A rectifier circuit 46 includes a full-wave rectifier 42 and a smoothing capacitor 44. The secondary winding of the isolation transformer 36 is coupled with the input terminals of the rectifier 42. The rectifier circuit 46 is connected to the filament 52 of X-ray tube 50 through a current detecting resistor 48 and to a stabilized DC power source 54 for driving various circuits which will subsequently be described.

A filament current detecting circuit 60 comprises an operational amplifier 58 which is connected at an inverting input terminal to a node between the resistor 48 and the filament 52 through a resistor 56, and at the non-inverting input terminal to a node between the resistor 48 and the capacitor 44 through a resistor 57 and the DC power source 54.

An analogue to digital converter (A-D converter) designated by reference numeral 62 is coupled at the input to the output of the operational amplifier 58, and is driven by the stabilized DC power source 54. Responsive to an analogue signal from the operational amplifier 58, the A-D converter 62 produces bit parallel digital signals including a plurality of bits representing logical "1" or "0". The A-D converter 62 has a plurality of output terminals corresponding to the bit number. The output terminals of the A-D converter 62 are connected to the corresponding input terminals of a drive circuit 64. The drive circuit 64 has the output terminals corresponding to the input terminals. The drive circuit 64 is also driven by the stabilized DC power source 54.

A number of photo-couplers 661, . . . , and 66N are inserted between the drive circuit 64 and a pulse shaper 74. The photo-couplers 661, . . . , and 66N operate as isolation transmission paths for isolating the low tension primary side from the high tension second side. Each photo-coupler 66 is comprised of a light emission diode 68, an optical fiber 70 and a photo-transistor 72. The optical fiber 70 guides a bundle of lights from the light emission diode 68 to the photo-transistor 72. The photo-transistor 72 responds to the light to be conductive. As shown, the light emission diodes 68 are coupled to the output terminals of the drive circuit 64. The photo-transistors 72 are coupled to the input terminals of the pulse shaper 74. The light emission diodes 68 are driven to emit light when the corresponding output terminal of the drive circuit 64 feeds thereto a logical "1" output signal. The pulse shaper 74 operates to wave-shape incoming pulses delivered through the photo-coupler 66.

A digital to analogue converter (D-A converter) 76, which is coupled to the pulse shaper 74, converts the bit-parallel digital signals delivered from the pulse shaper 74 into an analogue signal. The D-A converter 76 is coupled at the output terminal to the inverting input terminal of an error amplifier 26 through an input resistor 78. The non-inverting input terminal of the operational amplifier 26 is connected through another input resistor 82 to the movable terminal of a variable resistor 80 across which a voltage $V_{DD}$ is applied.

Figure 2:
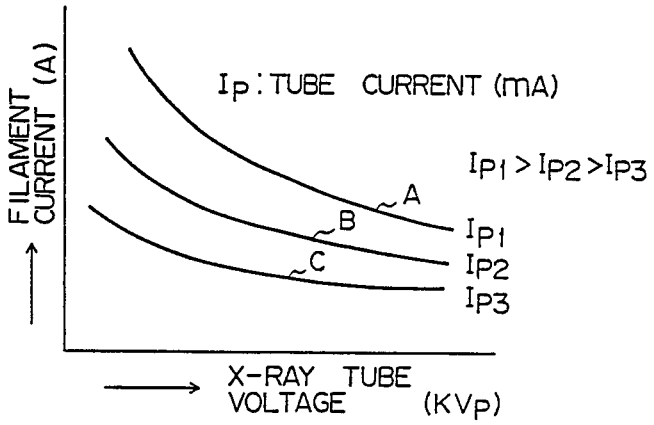
FIG. 2 shows variations of filament current with respect to X-ray tube voltage, with a parameter of tube current.

The variable resistor 80 performs as a function generator 84 for generating a signal representing a reference value of the filament current. The charcteristic of the filament current $I_F$(mA) to the tube voltage ($KV_P$) is diagramatically illustrated as indicated by three curves A, B and C in FIG. 2. In the figure, the tube current $I_P$(A) is used as a parameter. As seen from this, the function generator 84 desirably produces reference value signals as indicated by the curves A, B and C. However, it is very difficult to manufacture a function generator having such an ideal characteristic. For this, the function generator practically used is so designed to have characteristic curves partially approximating to the curves A, B and C. The function generator may comprise a micro-processor with a random access memory.

In operation, an AC current from the AC power source 14 is rectified by the full-wave rectifier 16. The rectified current is supplied to the collector-emitter path of the current controlling transistor 22. The amount of current flowing through the collector-emitter path is controlled by adjusting the base current of the transistor 22. The DC current thus stabilized is fed to the center tap of the primary winding of the isolation transformer 36. Under this condition, a gate pulse from the gate pulse generator (not shown) is alternately applied to the bases of the transistors 38 and 40 to render the transistors alternately conductive so that a rectangular AC voltage appears at the secondary winding of the insolation transformer 36. The rectangular AC voltage is then rectified by the rectifier 42 and smoothed by the capacitor 44 and finally applied to the filament 52 of the X-ray tube 50. The smoothed DC current is also applied to the stabilized DC power source 54 serving as a power source for driving the amplifier 58, the A-D converter 62, and the drive circuit 64. The stabilized DC power source 54 adjusts the input DC voltage to produce a proper voltage output signal. The voltage produced across the resistor 48 by the current flowing to the filament 52 is applied to the inverting input terminal of the operational amplifier 58 where it is amplified and then is applied to the A-D converter 62. The A-D converter 62 converts the output signal from the amplifier 58 into bit parallel digital signals including a plurality of bits "1" or "0". The bit parallel digital signal means that it includes a plurality of bits and the contents of all these bits are simultaneously derived from the A-D converter 62. The digital signal is supplied to the drive circuit 64 in which the light emission diodes receiving the logical "1" bits operate to emit light while those receiving the logical "0" are inoperative and emit no light. Incidentally, as a matter of course, the amplitude of the output pulse of the drive circuit 64 must be large enough to drive the light emission diodes 68. The light is guided by the corresponding optical fibres 70 to the corresponding phototransistor 72. Upon receipt of the light, the photo-transistor 72 conducts to produce pulses. The pulses are wave-shaped by the pulse shaper 74 to produce proper waveforms. Bit parallel digital signals from the pulse shaper 74 are supplied to the D-A converter 76 where those digital signals are converted into an analogue signal. The analogue signal from the D-A converter 76 is applied through the resistor 78 to the inverting input terminal of the error amplifier 26. The amplifier 26 receives at the non-inverted input terminal the reference value signal from the function generator 84, through the input resistor 82. The amplifier 26 produces a voltage signal corresponding to the difference between the reference value signal applied to the non-inverting input terminal and the analogue signal from the D-A converter 76 applied to the inverting input terminal. The voltage signal is applied to the base of the current control transistor 22. The current flowing through the collector-emitter path of the transistor 22 is controlled by the voltage signal from the error amplifier 26. By controlling the current flowing through the collector-emitter path, the voltage applied to the primary winding of the isolation transformer 36 is controlled and thus the current flowing through the filament 52 is controlled. The current flowing through the filament is kept at the current value represented by the reference value signal. As described above, in this embodiment, the filament current flowing through the secondary winding of the isolation transformer 36, that is to say, the filament current of the X-ray tube 50, is detected; the difference between the filament current and the reference signal is calculated; the difference thereof is used to control the voltage applied to the primary winding of the transformer to be constant. Therefore, the filament current may be properly controlled even if the transformer is aged. Further, the filament current at the high tension side of the apparatus is digitalized and the digitalized signal is taken after passing through the isolation transmission path 66. The signal is easily and precisely processed so that the filament current control is precisely performed.

Figure 3:
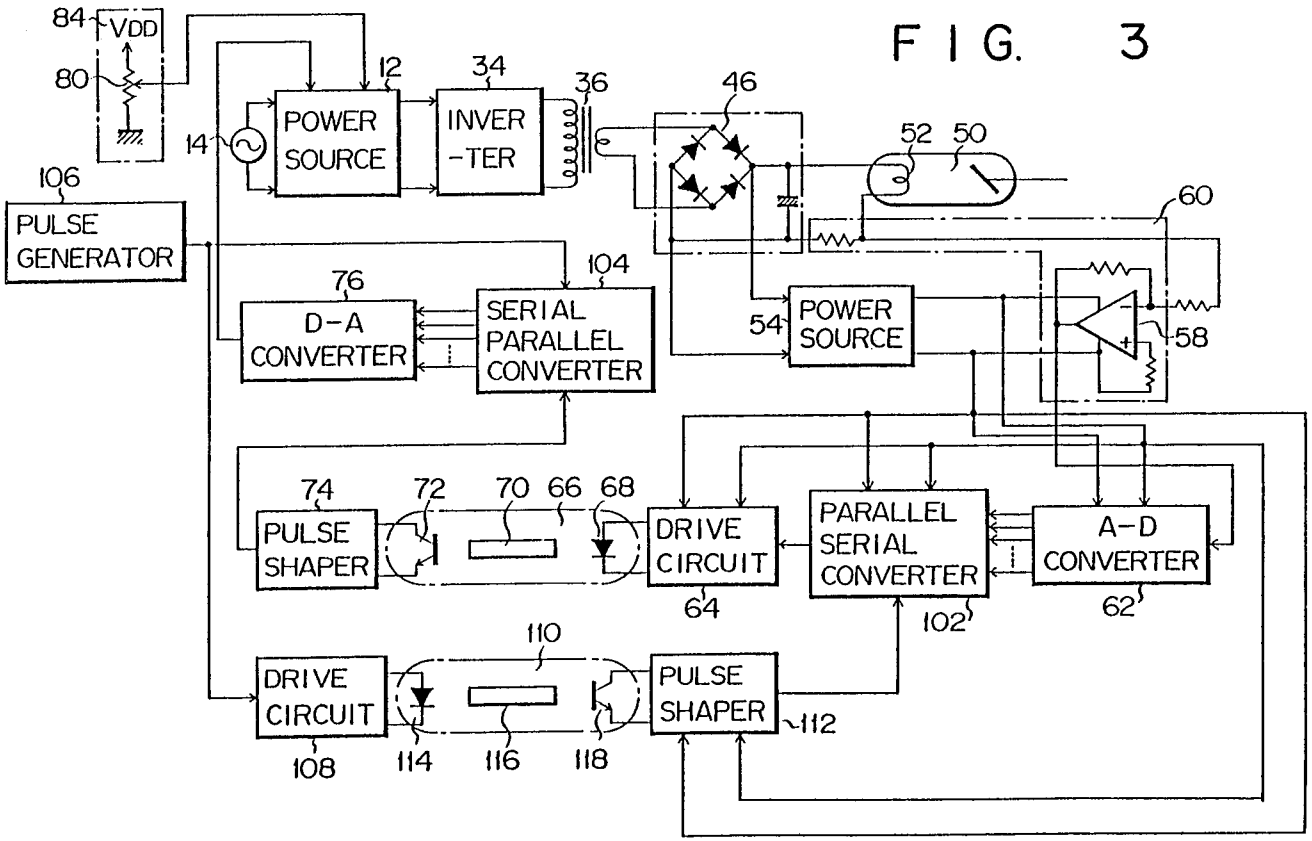
FIG. 3 shows a block diagram of another filament heating apparatus according to the invention.

To illustrate another embodiment of the invention, reference is now made to FIG. 3. In the figure, like numerals will be used to designate like parts or portions in FIG. 1. As shown, in this embodiment inserted between the drive circuit 64 and the A-D converter 62 is a parallel-serial converter 102 for converting a bit parallel digital signal into a bit serial digital signal. Here, the bit serial digital signal means that it includes a plurality of bits arranged in serial fashion and the contents of each bit is derived in sequence. Further, disposed between the pulse shaper 74 and the D-A converter 76 is a serial-parallel converter 104 for converting a digital signal from parallel form to serial. A timing pulse generator 106 is additionally provided connecting to the serial-parallel converter 104. The timing pulse generator 106 is also coupled to the parallel-serial converter 102, through an isolation transmission path including a drive circuit 108, a photo-coupler 110 and a pulse shaper 112. The photo-coupler 110 may be of the same type as that provided between the drive circuit 64 and the pulse shaper 74. The photo-coupler 110, which is inserted between the pulse shaper 112 and the drive circuit 108, is comprised of a light emission diode 114 emitting light responsive to the output pulse from the drive circuit 108, an optical fiber 116 for guiding the light from the light emission diode 114 and a photo-transistor 118 which is rendered conductive in response to the light from the light emission diode 114. It is to be noted here that, because of use of the bit serial fashion of the input digital signal to the drive circuit 64, the input and output terminals of the drive circuit 64 are each single. This leads to necessity of a single photo-coupler at the output side of the drive circuit 64. Incidentally, the serial-parallel converter 104, the drive circuit 108, and the timing pulse generator 106 are driven by a proper DC power source (not shown).

The operation of the heating apparatus shown in FIG. 3 is substantially the same as that of the filament heating apparatus shown in FIG. 1. Therefore, the operation of the embodiment in FIG. 3 will be referred only to the different portions, for simplicity. In synchronism with the timing pulse from the timing pulse generator 106, the parallel-serial converter 102 converts the bit parallel digital signal to the bit serial digital signal. As a matter of course, the bit parallel digital signal from the A-D converter 62 corresponds to the value of the filament current. The bit serial digital signal is applied to the serial-parallel converter 104, through the photo-coupler 66 and the pulse shaper 74. The serial-parallel converter 104 converts the bit serial digital signal into a bit parallel digital signal, in synchronism with the timing pulse received from the timing pulse generator 106. The bit parallel digital signal from the serial-parallel converter 104 is converted into an analogue signal by the D-A converter 76. The remaining part of the operation of this embodiment is the same as that of the embodiment shown in FIG. 1. Accordingly, the explanation of it will be omitted here.

According to this embodiment shown in FIG. 3 the circuit construction of the drive circuit 64 may be simplified of which the input and output terminals are each of single one, because the bit parallel digital signal from the A-D converter 62 is converted into the bit serial digital signal by the parallel-serial converter 102. Further, the photo-coupler 66 between the A-D converter 62 and the D-A converter 76 may be also a single one.

In the embodiments in FIGS. 1 and 3, the photocoupler is used for the isolation transmission path for feeding back a detected signal at the secondary winding side of the isolation transformer to the primary winding side. However, the photo-coupler may be substituted by an isolation transformer. In the type in which the detection signal is fed back in bit serial fashion as in the embodiment of FIG. 3, adoption of the phase locked loop system would allow the insulation transmission path for transmitting timing pulse to be omitted.

Figure 4:
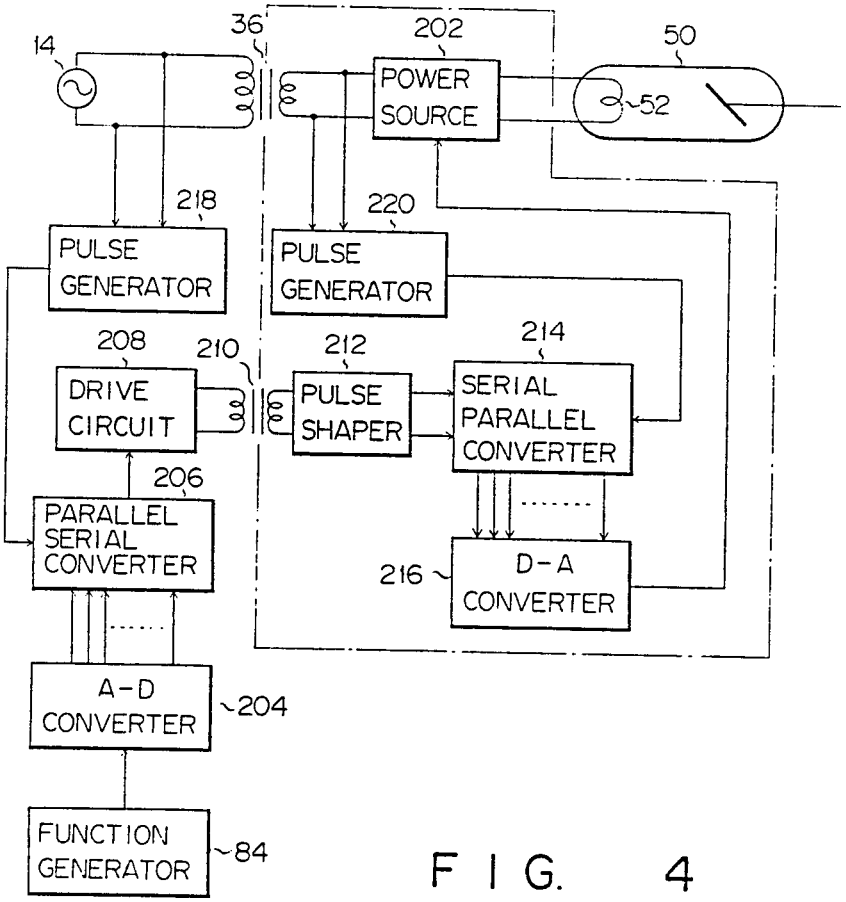
FIG. 4 shows a block diagram of still another filament heating apparatus according to the invention.

Turning now to FIG. 4, there is shown another embodiment of the filament heating apparatus according to the invention. As shown, an AC power source 14 is connected to the primary winding of the isolation transformer 36. The filament 52 of an X-ray tube 50 is connected to the secondary winding of the isolation transformer 36 through a stabilized DC power source 202. A function generator 84 is connected at the output terminal to the input terminal of the A-D converter 204. The A-D converter 204 is coupled to a parallel-serial converter 206.

Figure 5:
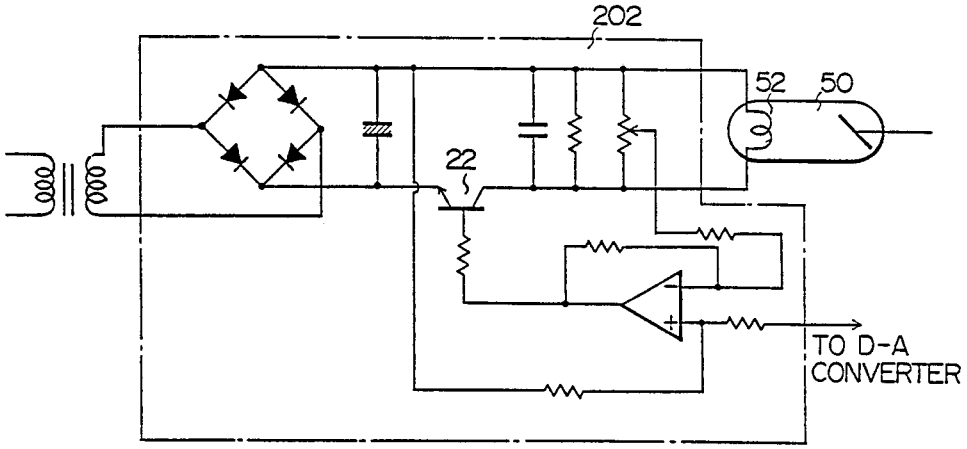
FIG. 5 shows a circuit diagram of a stabilized DC power source used in the apparatus in FIG. 4.

The parallel-serial converter 206 is connected to a drive circuit 208. The output terminal of drive circuit 208 is connected to the primary winding of a pulse transformer 210, the secondary winding of which is further connected to the input terminal of a pulse shaper 212. The pulse shaper 212 is coupled to a serial-parallel converter 214 which is also connected with the input terminal of a D-A converter 216. The D-A converter 216 is further connected to a stabilized power source 202. The construction and operation of the stabilized power source 202 are similar to these of embodiment shown in FIG. 1. Accordingly, the detailed explanation of it will be omitted with only illustration in its drawing in FIG. 5. A pulse generator 218 for generating timing signals is coupled to the parallel-serial converter 206. Similarly, another timing signal generator 220 is coupled to the timing input terminal of the serial-parallel converter 214.

In operation, a signal representing the reference value of the filament current from the function generator 84 enters the A-D converter 204 where its signal form is converted from analogue to digital in bit parallel. The digital signal from the A-D converter 204 is rearranged from bit parallel to bit serial by the parallel-serial converter 206 in synchronism with the timing pulse from the timing pulse generator 218. The drive circuit 208 controls its output pulse depending on the contents, i.e. logical "1" or "0", of each bit of the bit serial digital signal from the parallel-serial converter 206. Then, the pulse signal from the drive circuit 208 is transformed by the pulse transformer 210 and its distortion arising from the transformation is in turn corrected by the pulse shaper 212. The pulse shaped bit serial signal is again converted in its form from serial to parallel by the serial-parallel converter in synchronism with the timing pulse from the generator 220. The D-A converter 216 receives the bit parallel digital signal and converts it into analogue form for controlling the stabilized DC power source 202. As previously explained, the analogue signal controls the base current of the current control transistor so that the filament current of the X-ray tube is properly controlled.

Unlike the embodiments shown in FIGS. 1 and 3 of the feed-back system for filament current control, the heating system in FIG. 4 directly controls the filament current by means of the function generator 84. This simplifies the construction of the circuitry. The timing pulse generator 218 and 220 are so designed to produce pulses synchronizing with zero phase of the AC signal from the power source 14.

Figure 6:
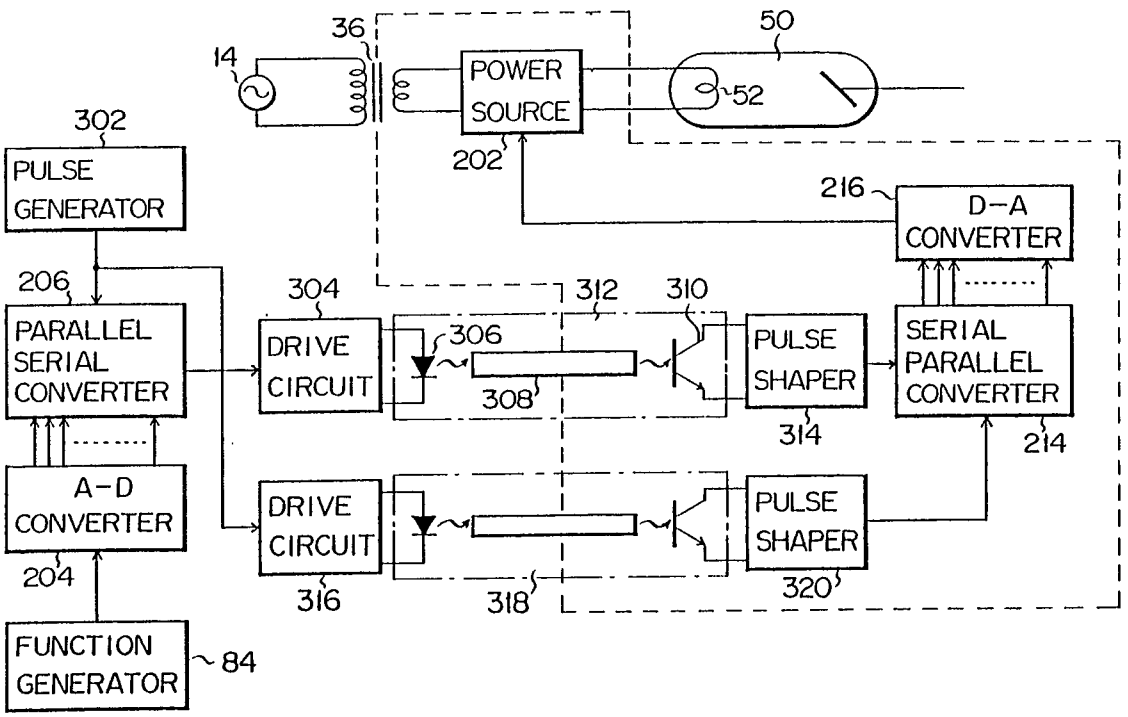
FIGS. 6 and 7 show block diagrams of other filament heating apparatus according to the invention.

Still another embodiment of the invention is shown in FIG. 6 in which like numerals are used to designate the like portions in FIG. 1 for avoiding unnecessary repitition of explanation. This embodiment also directly controls the filament current of the X-ray tube.

In the figure, a timing pulse generator 302 provides timing pulses to the parallel-serial converter 206 and the drive circuit 316. The digital signal from the converter 206 passes through the drive circuit 304, the photo-coupler 312 including the light emission diode 306, the optical fiber 308, and the photo-transistor 310, and the pulse shaper 314, and reaches the serial-parallel converter 214. In the converter 214, the signal form of the digital signal is converted into a bit parallel digital signal. The bit parallel digital signal is further converted into analogue signal at the D-A converter 216 to control the stabilized power source 202. The timing signal from the pulse generator 302 is also supplied to the timing input terminal of the serial-parallel converter 214, through another photocoupler path including the drive circuit 316, the photocoupler 318 which may be of the same type as the photo-coupler 312, and the pulse shaper 320. The reference value signal for filament current control from the function generator 84 is supplied through the A-D converter 204, and the first photocoupler path including the drive circuit 304, the photo-coupler 312, and the pulse shaper 314, the serial-parallel converter 214 and further the D-A converter 216, to finally the power source 202 where it controls the filament current as in the previously mentioned manner.

In this embodiment, the timing pulse generator 302 generates the timing pulses not in synchronism with the zero phase of the AC signal but with a properly selected period. For this, the sampling period of each digital signal from the parallel-serial and serial-parallel converters 206 and 214 is very short thereby to improve the stability of the filament current.

An additional embodiment of the invention will be given with reference to FIG. 7. In the figure, the same numerals are used to designate the same portions in FIGS. 4 and 6. As shown, in this embodiment, the reference value signal from the function generator 84 is processed in bit parallel fashion for controlling the filament current, and therefore the processing time of the signal is short enough to enable the filament current to be controlled in real time. The output signal from the function generator 84 is converted by the A-D converter 204 into a bit parallel digital signal. The bit parallel signal is directly applied to the photo-coupling path including the drive circuit 402, a number of photocouplers $\mathbf{404}_l$ to $\mathbf{404}_n$, and the pulse shaper 406. Note here that the parallel-serial converter and the serial-parallel converter are not used, and that the photo-coupling path is comprised of a number of parallel paths corresponding to the number of the bits included in the output signal from the A-D converter 204. Upon receipt of the bit parallel digital signal, the drive circuit 402 produces, at the output terminal corresponding to the "1" bit receiving input terminal, pulses having an amplitude enough to drive the light emission diode of the corresponding photo-couplers. The pulses transferred through the photocouplers are applied in parallel fshion to the pulse shaper 407 where those pulses distorted in the photocouplers are waveshaped. The parallel pulses are transferred in parallel to the D-A converter 216 where those pulses are converted into an analogue signal to be used to control the power source 202. The construction of each photocoupler 404 may be of the same as those used in the previous embodiments.

In the embodiment in FIG. 4, if the timing pulse generators 218 and 220 are so designed to produce pulses in synchronism with the zero crossing of the AC signal from the power source 14, then the signal distortion arising from alternate change of the magnetization direction of the pulse transformer 210 for each half cycle of the signal applied thereto is eliminated. Further, the pulse transformer 210 may be replaced by the photo-coupler.

Figure 7:
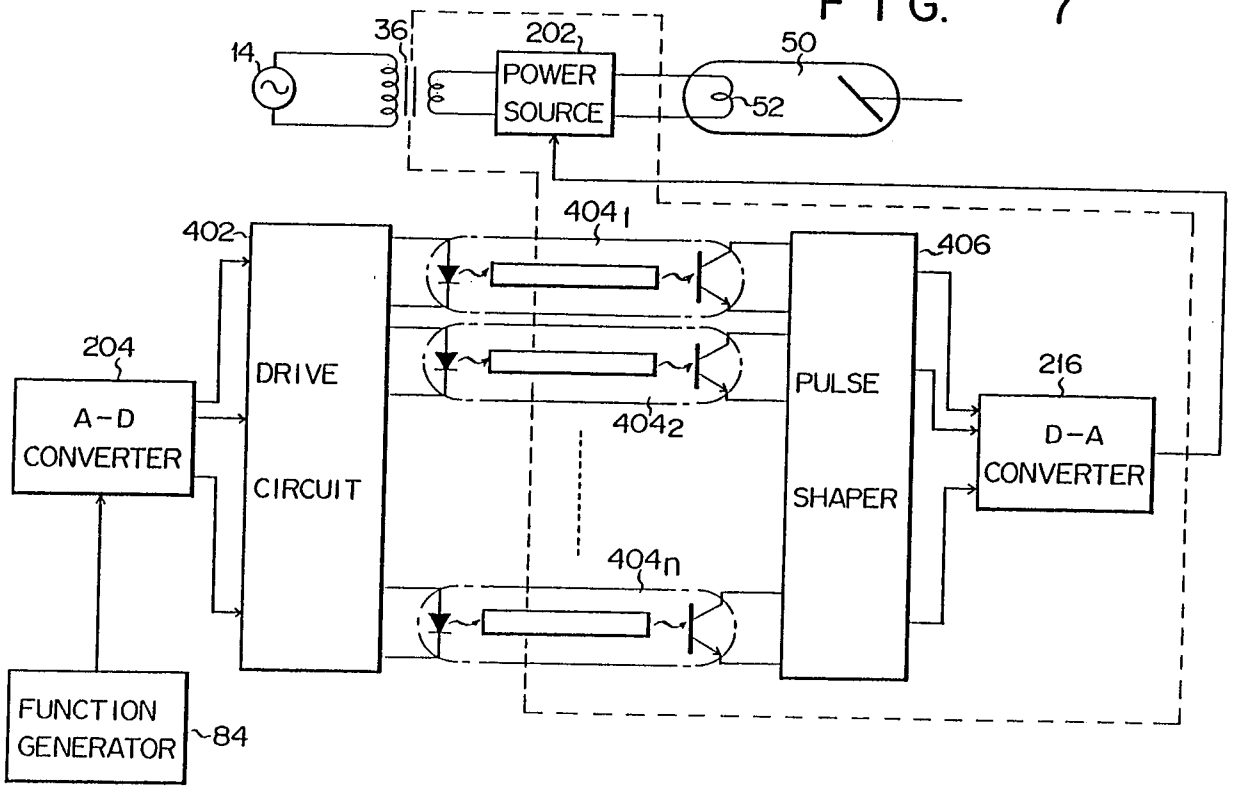

In the embodiments in FIGS. 6 and 7, the photo-coupler may be replaced by the isolation transformer. The function generators and A-D converters in all the embodiments may be controlled by a microprocessor with a digital memory. Other changes and modifications of the filament heating apparatus thus far mentioned may be possible within the scope and spirit of the invention.

What is claimed is:

1. A filament heating apparatus for an X-ray tube comprising:

means for generating a reference signal in accordance with the characteristics of said X-ray tube;

means for detecting a component of the filament current of said X-ray tube;

A-D convertor means for converting one of said reference signal and the component of the filament current into a digital signal;

D-A convertor means for converting said digital signal into an analogue signal;

isolation transformer means for coupling said digital signal to said D-A convertor means; and means for controlling the filament current to be substantially stable in response to said analogue signal.

2. A filament heating apparatus for an X-ray comprising:

a stabilized DC power source;

an isolation transformer connected at the primary winding side to said DC power source and adapted at the secondary winding side for connection to the filament of said X-ray tube;

a detection circuit for detecting a component of the filament current of said X-ray tube;

an A-D converter for converting an output signal from said detection circuit to a digital signal;

isolation transmission means for guiding a digital signal from said A-D converter;

a D-A converter for converting a digital signal transferred through said isolation transmission means from said A-D converter into an analogue signal;

a signal source for generating a signal representing a reference value of the filament current; and a control circuit for controlling the filament current in response to the output from said DC power source in accordance with the difference between the reference value signal from said signal source and the analogue signal as a signal at the secondary winding side from said A-D converter, thereby to supply a substantially stable filament current to said X-ray tube.

3. A filament heating apparatus for an X-ray tube according to claim 2, in which said digital signal from said A-D converter is a bit parallel digital signal and said isolation transmission means are the same in number as the number of bits of said digital signal.

4. A filament heating apparatus for an X-ray tube according to claim 2, in which said digital signal is a bit serial digital signal and said isolation transmission means is a single one.

5. A filament heating apparatus for an X-ray tube according to any one of claims 2 to 4, in which said isolation transmission means is a photo-coupler.

6. A filament heating apparatus for an X-ray tube according to claim 2, in which a rectangular AC signal is supplied to said isolation transformer.

7. A filament heating apparatus for an X-ray tube according to claim 2, in which the output signal at the secondary winding side of said isolation transformer is converted into a DC signal and then is applied to the filament of said X-ray tube.

8. A filament heating apparatus for an X-ray tube comprising:

an isolation transformer of which the primary winding is connected to an AC power source;

a stabilized DC power source whose output value is controlled by a control signal and which is connected at the input terminal to the secondary winding and adapted at the output terminal for connection to the filament of said X-ray tube;

a function generator for producing a signal representing a reference value of the filament current flowing through the filament;

an A-D converter for converting the reference value signal for the filament current into a digital signal;

isolation transmission means for guiding the digital signal from said A-D converter;

a D-A converter for converting the digital signal transferred through said isolation means from said A-D converter into an analogue signal which in turn is applied as said control signal to said stabilized DC power source.

9. A filament heating apparatus for an X-ray tube according to claim 8, in which said digital signal is a bit parallel digital signal.

10. A filament heating apparatus for an X-ray tube according to claim 8, in which said digital signal is a bit serial digital signal.

* * * * *